United States Patent [19]

Merz

[11] Patent Number: 4,553,908

[45] Date of Patent: Nov. 19, 1985

[54] HIGH PRESSURE PUMP WITH A FLOW CONTROL VALVE

[75] Inventor: Johann Merz, Bopfingen, Fed. Rep. of Germany

[73] Assignee: Zahnradfabrik Friedrichshafen, AG., Friedrichshafen, Fed. Rep. of Germany

[21] Appl. No.: 258,412

[22] Filed: Apr. 28, 1981

[30] Foreign Application Priority Data

May 16, 1980 [DE] Fed. Rep. of Germany ..... 3018650

[51] Int. Cl.[4] ..... F04B 49/00

[52] U.S. Cl. ..... 417/310

[58] Field of Search ..... 417/300, 310

[56] References Cited

U.S. PATENT DOCUMENTS 2,118,234 5/1938 Rupp ..... 417/502

2,782,718 2/1957 Pettibone ..... 417/204

*Primary Examiner*—Richard E. Gluck

*Assistant Examiner*—Jane E. Obee

*Attorney, Agent, or Firm*—Zalkind & Shuster

[57] ABSTRACT

A rotary slide vane pump for steering booster systems has a flow control valve which bypasses flow from outlet side to suction side with increase in speed as heretofore known. The flow channels or passages that conduct bypass flow change the direction of the flow at a juncture point between passages, such directional change being a right angle, radially downstream from the bypass valve to longitudinally at the point of juncture to the suction side, likewise as heretofore known. In the present invention there is provided a transition piece between the channels at the right angle juncture in the form of a screw in the pump body and having a flat face disposed flush with the longitudinal channel and transversely of the radial channel. The provision of such transition piece has been found to effect an increase in suction pressure when bypass flow is added to normal suction flow, such increase being over and above that effected by the prior art. The result is an enhanced suction volume in pump operation, avoidance of cavitation damage due to insufficient intake filling and reduction of noise.

3 Claims, 4 Drawing Figures

HIGH PRESSURE PUMP WITH A FLOW CONTROL VALVE

The invention relates to a high pressure pump suitable for booster steering systems and which utilizes a bypass or flow control valve responsive to speed to divert outlet flow to the suction side of the pump. Such arrangements are particularly useful in booster steering systems in order to regulate pump output so as to render the steering system uniform in response to a steering operation for precise control.

A pump of the general type described is shown in the patent to Pettibone, U.S. Pat. No. 2,782,718, issued Feb. 26, 1957. This prior art patent shows a flow control valve on the same axis as the driving shaft of a rotor of the sliding vane type of rotary pump. The flow control valve is a bypass valve of the piston type having one face exposed in a pressure chamber communicating with the pump outlet. At higher speeds of the pump when there is an excess of outlet flow pressure in the chamber acting, the valve effects movement against a spring and a hydraulic force in a manner to cause a portion of the outlet flow to communicate with a radial bypass passage and thence with a longitudinal passage to the suction side of the pump. An inlet passage connects to a tank and intersects the radial passage. In particular, the radial passage has a right angle juncture with a longitudinal passage and continues therethrough to the exterior of the pump where it is capped. The portion of the radial passage which traverses beyond the longitudinal passage thus forms a pocket which does not relate to any flow of useful oil but does result in a high flow resistance when the oil flow must change direction from radial to longitudinal. The condition is aggravated further by the fact that the main suction flow coming into the radial passage and mingling with bypass flow is also effected. Accordingly, it is not possible to secure a complete or sufficient filling of the vane chambers formed by the operating slides and cavitation results which is damaging to the pump.

The present invention avoids the resistance to flow at the right angle juncture between the radial and longitudinal passages or at least maintains such resistance to a minimum to improve filling of the vane chambers.

The invention utilizes a screw threadedly carried in the pump body and which has a surface set flush with the interior surface of the longitudinal passage. Inasmuch as the longitudinal passage is flat sided, the face of the screw can form a part of the surface across which oil flows.

Since in a die cast pump the radial passage is necessarily achieved by drilling, there always must remain a vestigial portion of the bore to the exterior of the pump body, and it is this vestigial portion which is filled up by the screw which effects by a flat face the substantial reduction in flow response in the area of change of direction. This particular invention serves to provide an increased flow on the suction side of the pump in that the high pressure bypass flow entrains the usual suction flow entering the pump from a tank.

Accordingly, the improvement of increased flow on the suction side is particularly noticeable when a pump delivers at almost zero pressure, that is, when the engine is idling and at higher speeds. The result is the avoidance of cavitation damage and a reduction in operating noise due to increase in inlet chamber pressure increasing the filling of the vane chambers.

A detailed description of the invention now follows in conjunction with the appended drawing, in which FIG. 1 is a longitudinal section through a vane pump with a flow control valve;

Figure 1:
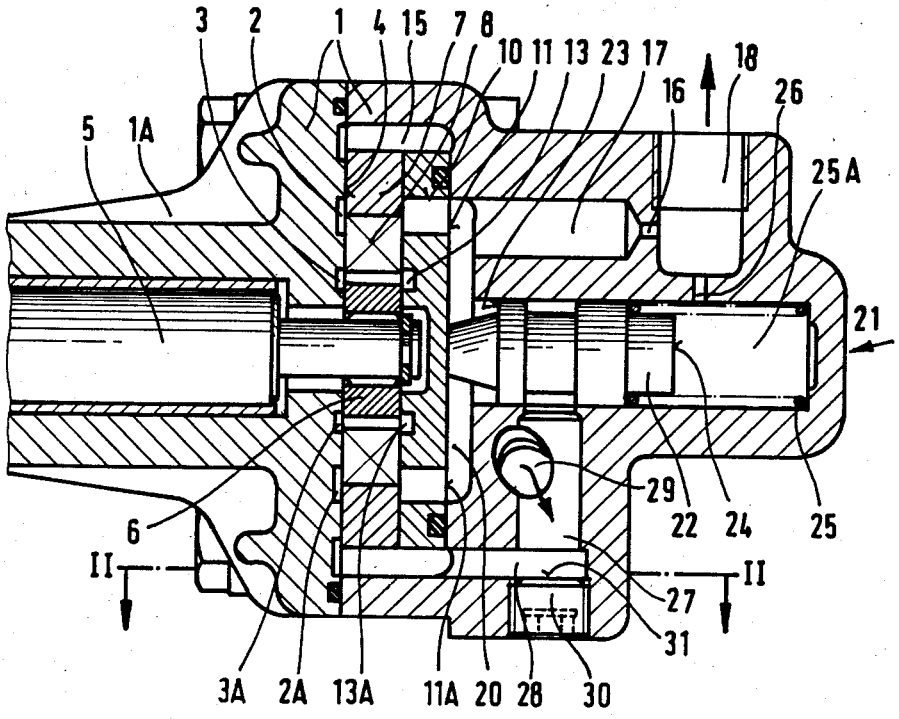
Figure 2:
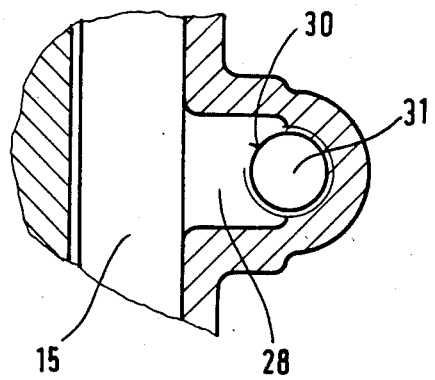
FIG. 2 is a section on line II—II of FIG. 1.

With reference to FIGS. 1 and 2, a die cast pump housing 1 has two sections, with stiffening ribs 1A. One body section has a face 4 with channels 2, 3, 2A and 3A for suction flow. A drive shaft 5 carries a rotor 6 splined thereto in the housing. Rotor 6 has radial slots for the slidable vanes 8 within a cam ring 7 which will be understood to have an internal eccentric surface which motivates the vanes to achieve pumping in the other body section. A separate flow control plate or cheek plate 10 is contiguous with the cam ring 17 and has outlet pressure passages 11 and 11A. Partly annular oil channels 13 and 13A connect the lower ends of the vane slots. The vane chambers, that is the pumping chambers between the vanes, are not shown on the drawing but will be understood to be formed by the vanes. The rotor 6 and the cam ring 7 communicate with an annular inlet chamber 15 from an inlet passage 29 which will be further understood to connect to a suction port for tank connection. Hydraulic oil delivered by the vane chambers passes through outlet passages 11 and 11A in the flow control plate 10 to a pressure chamber 20 recessed in the other body section, as shown. Such outlet pressure flow thence passes through a bore 17 having a metering orifice 16 and ultimately to an outlet port 18.

The bypass or flow control valve 21 is disposed on the same axis as drive shaft 5, as noted in FIG. 1, and comprises a valve piston 22 of the spool type having a face 23 exposed in the pressure chamber 20. The opposite face 24 of the valve is biased by a spring 25 in a pressure chamber 25A. Pressure chamber 25A communicates with the outlet port 18 through a restricted choke orifice 26. In operation of flow control valve 21, high pressure oil effected by the vane chambers between vanes 8 flows into pressure chamber 20 and forms a working flow for a servomotor or the like via bore 17, metering orifice 16 and outlet port 18. With increase of pump speed there is a differential pressure acting on the valve 21 due to increase of pressure on face 23, an effect of the metering orifice 16. This motivates piston 22 against the force of spring 25 as well as against the force of outlet pressure in chamber 25A. Accordingly, the radial passage 27 is opened and a partial flow bypasses to a flat sided longitudinal channel 28 having a right angle juncture with the radial passage and which channel 28 connects with the inlet channels in the face 4. Meanwhile, flow from a tank via a passage 29 which intersects radial passage 27 occurs, which is entrained by the bypass flow occasioned by the opening of valve 21 mingling therewith as suction flow to the suction side of the pump.

As has been heretofore set forth, it is necessary to close the end of the bore of the radial passage 27 which was left existing as a result of drilling the bore in a die cast pump housing. Such closure is by means of a screw 30 threadedly carried in the pump body and having a flat face 31 which becomes flush with the adjoining flat face of the channel 28, as will be appreciated from comparing FIGS. 1 and 2. Of course, a plug instead of a screw could be used.

Figure 3:
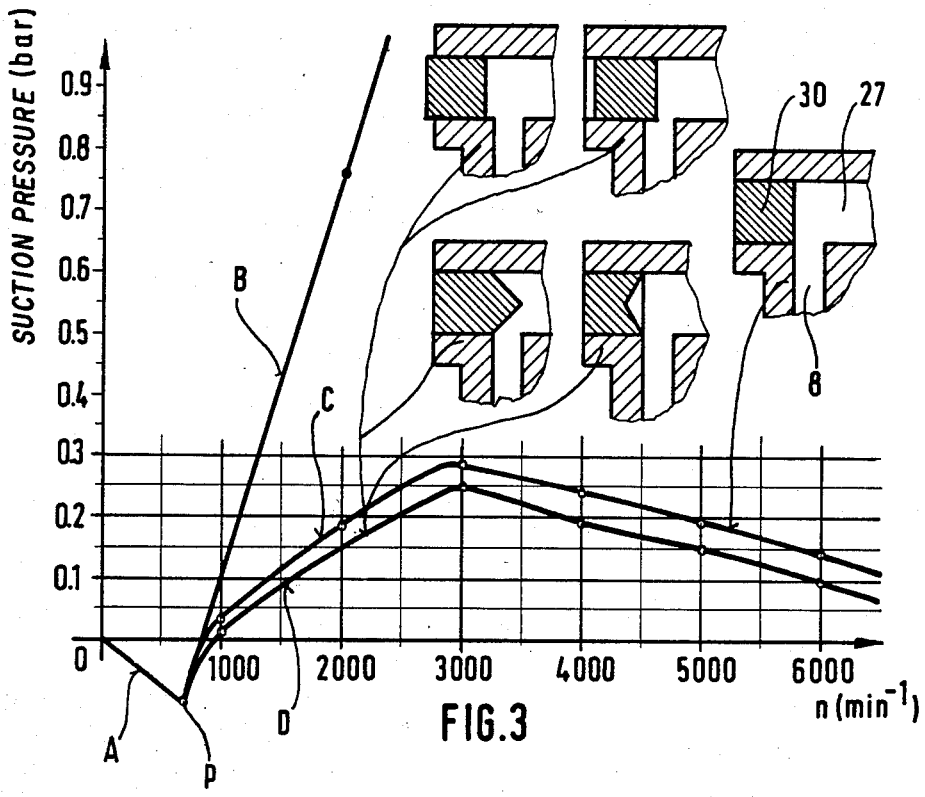
FIG. 3 is a graph of comparative curves produced by various shapes of faces of screws showing suction pressure vs. speed.
Figure 4:
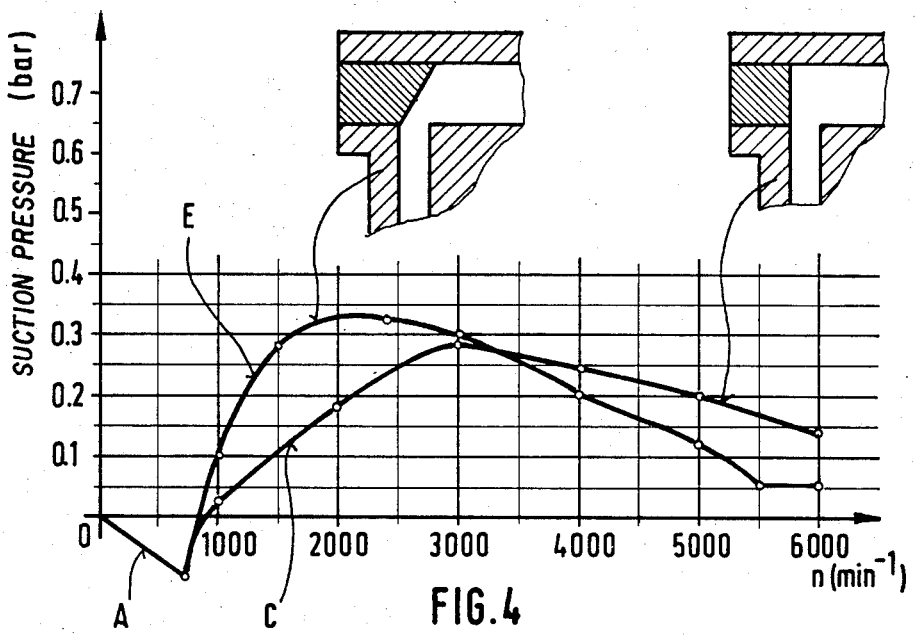
FIG. 4 is a similar graph particularly exmplifying the effect of a flat face screw flush with the longitudinal passage as compared with a screw having a slanted face.

The diagrams of FIGS. 3 and 4 show the increasing suction pressure vs. speed which various faces and/or position depths of screw 30.

In FIG. 3, the falling section A of the suction pressure curve shows the range before suction pressure increase. After a point p is reached, flow control valve 21 opens and a partial bypass flow occurs which increases suction pressure. Thus, as illustrated in FIG. 3, emanating from the point p, the suction pressure curve A divides into three groups, B, C and D. Curve B shows the suction pressure increase with a consumer device connected for approximately 50 bars of operating pressure of the pump. In such case, suction pressure increase is no problem.

By contrast, curves C and D show the effect for minimum flow pressure at approximately 2 bars. Curve C illustrates the path optimized by the invention using the screw 30 having a flat face 31 flush with the flat side of channel 28. Curve D shows a lesser result with the screw positioned so that the face is not exactly flush but approximately 1 mm. below or above the surface of the channel. Screws with a circular symmetrical face such as cones which are concave or convex result in suction pressures shown below the curve C. Such latter screws were just as position sensitive as were the non-flush flat face screws as seen in curve D even though the vestigial bore of channel 27 was filled up completely.

In FIG. 4, the curves A and C as shown in FIG. 3 are again shown, but in comparison with a curve E showing increase of suction pressure for a sloping face of the screw. It would appear that a slope face of the screw facilitates suction pressure but this is only partially correct. Up to approximately 3000 min.$^{-1}$, the suction pressure increase is admittedly better than for a screw with a flat face. However, thereafter suction pressure is markedly inferior, as will be noted from comparison with the curves C and E beyond the cross-over point with speed increase. Experience has shown that cavitation damage occurs only at higher speeds. Accordingly, it is important that the vane chambers be filled as far as possible at higher speeds and the increase in suction pressure effected by the flush flat-faced screw achieves such an advantage.

What is claimed is:

1. In a sliding vane rotary pump of the kind having a flow control valve in the pump disposed between an outlet chamber and a radial passage extending as a bore through a wall of the pump body;

said flow control valve operable by outlet pressure responsive to pump speed to bypass high pressure flow to said radial passage;

said pump having a longitudinal passage intersecting said radial passage and having an angular juncture with said radial passage and connecting to the inlet chamber of said pump, including an inlet passage intersecting said radial passage whereby inlet flow is entrained by high pressure bypass flow upon opening of said flow control valve for flow to said inlet chamber;

the improvement which comprises:

a closure member for the bore through the pump body wall comprising a flow guiding transition piece at the juncture of said radial and longitudinal passages having a face flush with a side of said longitudinal passage whereby said radial passage terminates in said longitudinal passage.

2. In a sliding vane rotary pump as set forth in claim 1, wherein the side of said longitudinal passage is a flat side and wherein the face of said closure member is flat.

3. In a sliding vane rotary pump as set forth in claim 2, wherein said closure member is a screw threadedly carried in said pump body wall.

* * * * *